US007287713B2

(12) United States Patent
Akuzawa et al.

(10) Patent No.: US 7,287,713 B2
(45) Date of Patent: Oct. 30, 2007

(54) ICE SHAVER FOR BEVERAGE DISPENSER

(75) Inventors: Takayuki Akuzawa, Gunma (JP); Yoshiaki Inokuma, Maebashi (JP); Saori Kuribara, Isesaki (JP)

(73) Assignee: Sanden Corporation, Isesaki-Shi, Gunma (JP)

( * ) Notice: Subject to any disclaimer, the term of this patent is extended or adjusted under 35 U.S.C. 154(b) by 0 days.

(21) Appl. No.: 11/342,283

(22) Filed: Jan. 30, 2006

(65) Prior Publication Data

US 2006/0186236 A1 Aug. 24, 2006

(30) Foreign Application Priority Data

Feb. 1, 2005 (JP) ..... 2005-025323

(51) Int. Cl.
*B02C 17/00* (2006.01)

(52) U.S. Cl. ..... 241/88.1; 241/DIG. 17

(58) Field of Classification Search ..... 241/65, 241/DIG. 17, 101.2, 86.1, 88.1; 62/344
See application file for complete search history.

(56) References Cited

U.S. PATENT DOCUMENTS 5,056,688 A 10/1991 Goetz et al.
6,082,130 A 7/2000 Pastryk et al.
6,334,327 B1 * 1/2002 Fujiwara ..... 62/320
2006/0248912 A1 * 11/2006 Park et al. ..... 62/344

FOREIGN PATENT DOCUMENTS

JP 60196574 A 10/1985
JP 05240545 A 9/1993
JP 10-174556 6/1998
JP 2002062006 A 2/2002
JP 2005042938 A 2/2005

OTHER PUBLICATIONS

European Search Report dated May 18, 2007 in Application No. EP06 25 0494.

* cited by examiner

*Primary Examiner*—Faye Francis
(74) *Attorney, Agent, or Firm*—Banner & Witcoff, Ltd

(57) ABSTRACT

An ice shaver for a beverage dispenser for charging solid granular ice into cups and shaving granular ice and charging it into cups. An ice charging port opening arranged to expose the part of one end surface of the impeller in the direction of the impeller central axis including the spindle allows granular ice to be charged into the ice shaver body while being agitated by the impeller ameliorate clogging of the bottom end side of the introduction pipe. Also, because the impeller is rotated at a low speed in discharging granular ice, the discharge speed of the ice is reduced, reducing scattering of beverage already in the cup. Furthermore, when an overload occurs in a motor due to the impeller locking caused by clogging with granular ice, driving of the impeller is stopped. Therefore, the motor and a motor drive section are protected from damage due to over current and heating.

8 Claims, 9 Drawing Sheets

ICE SHAVER FOR BEVERAGE DISPENSER

BACKGROUND OF THE INVENTION

1. Field of the Invention

The present invention relates to an ice shaver used in a beverage dispenser for selling beverages contained in cups.

2. Description of the Related Art

There have been known conventional beverage dispensers which are provided with beverage producing equipment, such as a cup discharger, a water cleaner, a warm water generator, raw material storage bins, a coffee extractor, an icemaker and an agitator, and produce and supply beverages in cups in accordance with prescribed procedures on the basis of the insertion of money and the selection of beverages.

Also, as devices which produce beverages in sherbet form, there have been known those which are provided with an ice shaver for shaving ice in solid form and produce beverages in sherbet form by mixing the ice shaved by the ice shaver with raw material liquids, such as a coffee liquid.

However, conventional beverage dispensers cannot produce shaved ice used in beverages in sherbet form although they can produce granular ice in solid form for use in ice beverages by use of an icemaker. For this reason, with conventional beverage dispensers, it has hitherto been impossible to sell beverages in sherbet form.

SUMMARY OF THE INVENTION

The object of the present invention is to provide an ice shaver for a beverage dispenser which can charge granular ice in solid form into cups and which can also shave granular ice and charge shaved ice into cups.

To achieve the above object, the present invention provides an ice shaver for a beverage dispenser which comprises: an icemaker body having an ice charging port, a granular ice discharging port and a shaved ice discharging port; a cutting blade provided in the vicinity of the shaved ice discharging port of the ice shaver body; and an impeller which is rotatably provided within the ice shaver body, is provided in such a manner that a part of one end surface thereof in a direction of a central axis including a center of rotation is exposed from the ice charging port, discharges granular ice charged from the ice charging port into the ice shaver body from the granular ice discharging port by being rotated in one direction, shaves the granular ice charged from the ice charging port into the ice shaver body, and discharges the shaved ice from the shaved ice discharging port by being rotated in the other direction.

As a result of this, because an opening of the ice charging port is provided so as to expose the part of one end surface of the impeller in the direction of the central axis including the center of rotation, at the ice charging port the granular ice is charged into the ice shaver body while being agitated by the impeller. Therefore, at the ice charging port the granular ice can be charged into the ice shaver body while being agitated by the impeller, which provides the advantage that irregularities such as clogging with granular ice do not occur.

Also, the present invention provides an ice shaver for a beverage dispenser which comprises: an icemaker body having an ice charging port, a granular ice discharging port and a shaved ice discharging port; a cutting blade provided in the vicinity of the shaved ice discharging port of the ice shaver body; an impeller which is rotatably provided within the ice shaver body, discharges granular ice charged from the ice charging port into the ice shaver body from the granular ice discharging port by being rotated in one direction, shaves the granular ice charged from the ice charging port into the ice shaver body, and discharges the shaved ice from the shaved ice discharging port by being rotated in the other direction; a motor which rotates the impeller in one direction and in the other direction; and a rotational speed changeover unit which sets the rotational speed of the motor at a prescribed first rotational speed when the impeller is rotated in the other direction and at a prescribed second rotational speed which is lower than the first rotational speed when the impeller is rotated in one direction.

As a result of this, because the motor revolves at a low speed when the impeller is rotated in a normal direction in discharging granular ice, the discharge speed of the granular ice discharged from the ice shaver body decreases. Therefore, because it is possible to reduce the discharge speed of the granular ice discharged from the ice shaver body, it is possible to prevent the scattering of a beverage when granular ice is charged into a cup.

Also, the present invention provides an ice shaver for a beverage dispenser which comprises: an icemaker body having an ice-charging port, a granular ice discharging port and a shaved ice discharging port; a cutting blade provided in the vicinity of the shaved ice discharging port of the ice shaver body; an impeller which is rotatably provided within the ice shaver body, discharges granular ice charged from the ice charging port into the ice shaver body from the granular ice discharging port by being rotated in one direction, shaves the granular ice charged from the ice charging port into the ice shaver body, and discharges shaved ice from the shaved ice discharging port by being rotated in the other direction; a motor which rotates the impeller in one direction and in the other direction; and a driving stop unit which stops the driving of the motor when rotation resistance higher than a prescribed level acts on the impeller which is rotating.

As a result of this, because the driving of the motor is stopped when the revolutions of the motor are stopped by the lock of the impeller, the motor and the motor driving circuit are protected from damage due to overcurrent and heating. Therefore, because it is possible to protect the motor and the motor driving circuit from damage due to overcurrent and heating, it is possible to prevent troubles in the equipment.

As a result of this, because granular ice can be charged into a cup and also it is possible to shave granular ice and to charge shaved ice into a cup, it becomes possible to sell ice beverages using granular ice and to sell frappe beverages in semi-solid form.

The above object of the present invention and other objects, features and advantages thereof will become apparent from the following descriptions and accompanying drawings.

DESCRIPTION OF THE PREFERRED EMBODIMENTS

A beverage dispenser provided with an ice shaver of the present invention can sell, for example, hot beverages and ice beverages, such as coffee, black tea and cocoa, and also frappe beverages in semi-solid form which are produced by mixing shaved ice obtained by shaving granular ice in solid form with liquid raw materials such as a coffee liquid.

Figure 1:
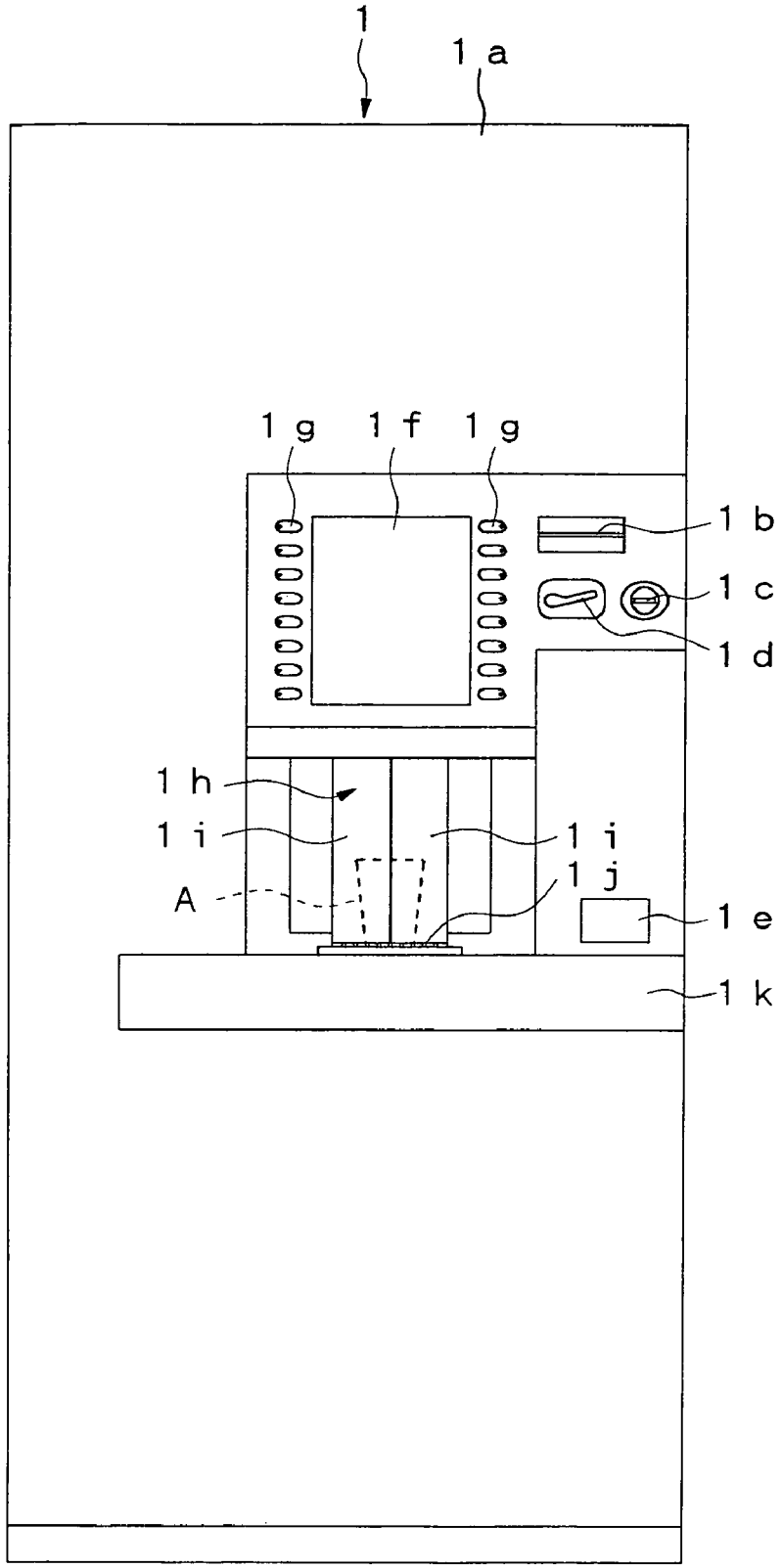
FIG. 1 is a front view of a beverage dispenser in an embodiment of the present invention.

A dispenser casing body 1 shown in FIG. 1 is provided with a cabinet having an open front surface and a door 1*a* rotatably provided in a front opening of the cabinet. Within the dispenser casing body 1 are built an ice shaver 10, which will be described later, and beverage producing equipment, such as a cup discharger, a water cleaner, a warm water generator, raw material storage bins, a coffee extractor, an icemaker and an agitator, which are not shown in the drawing.

On the front surface of the door 1*a* are provided a bill slot 1*b*, a coin slot 1*c*, a return lever 1*d*, a coin return opening 1*e*, a liquid crystal display 1*f* and multiple operation buttons 1*g* of the liquid crystal display 1*f*, which are arrayed right and left. Also, below the liquid crystal display 1*f* on the front surface of the door 1*a* are provided a cup discharging port 1*h* having the shape of a vertically long rectangle, a pair of right and left slide doors 1*i* which opens and closes the cup discharging port 1*h*, a cup placement table 1*j* provided outside the cup discharging port 1*h*, and a handy table 1*k* provided so as to overhang ahead of the front surface of the door 1*a*.

The ice shaver 10 is equipped with an ice shaver body 11 provided below the icemaker, an impeller 12 rotatably provided within the ice shaver body 11, and a cutting blade 13 attached to a lower part of the ice shaver body 11.

The ice shaver body 11 is fabricated from a hollow cylindrical member both ends of which are closed, and provided in such a manner that a central axis thereof extends in a horizontal direction. On the side of one end of the ice shaver body 11 in an axial direction thereof, an ice charging port 11*a* is provided, and in this ice charging port 11*a*, an opening thereof is disposed in a position which expose a part of one end surface of the impeller 12 in the direction of a central axis of impeller 12 including a spindle 12*a*. Also to the ice charging port 11*a* is connected an ice introduction pipe 11*b* which introduces granular ice discharged from the icemaker into the ice charging port 11*a*, and this ice introduction pipe 11*b* is provided so as to extend upward. In the lower part of the ice shaver body 11, a shaved ice discharging port 11*c* which extends in the axial direction of the ice shaver body 11 is provided, and a cutting blade 13 is fixed in the vicinity of the shaved ice discharging port 11*c*. In the upper part of the ice shaver body 11, a granular ice discharging port lid is provided so as to extend tangentially during the normal rotation of the impeller 12 and also extend upward, and there is formed a granular ice guide passage 11*e* for guiding the granular ice discharged from the granular ice discharging port lid to the vicinity of the shaved ice discharging port 11*c*.

Figure 2:
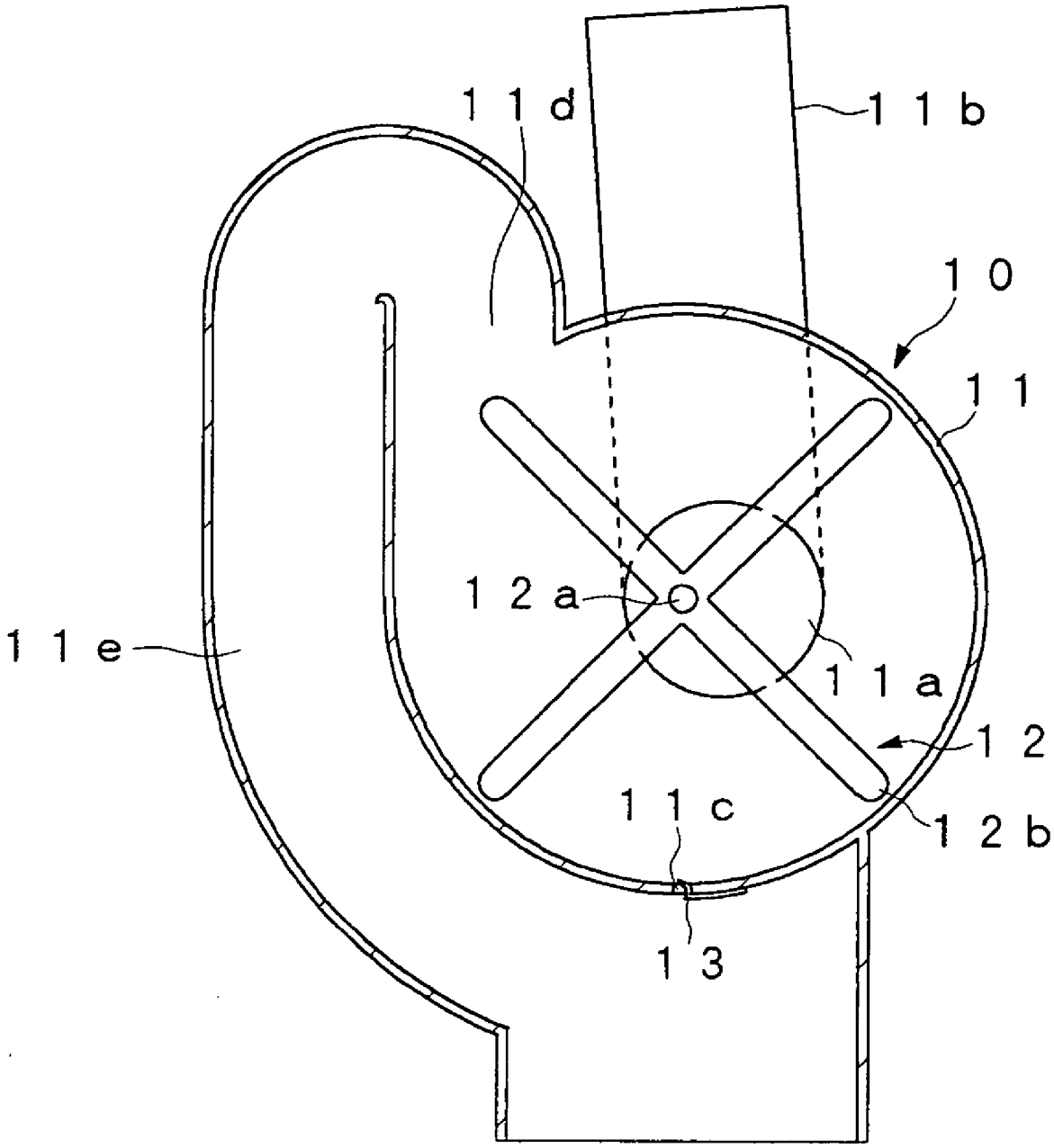
FIG. 2 is a side sectional view of an ice shaver.
Figure 3:
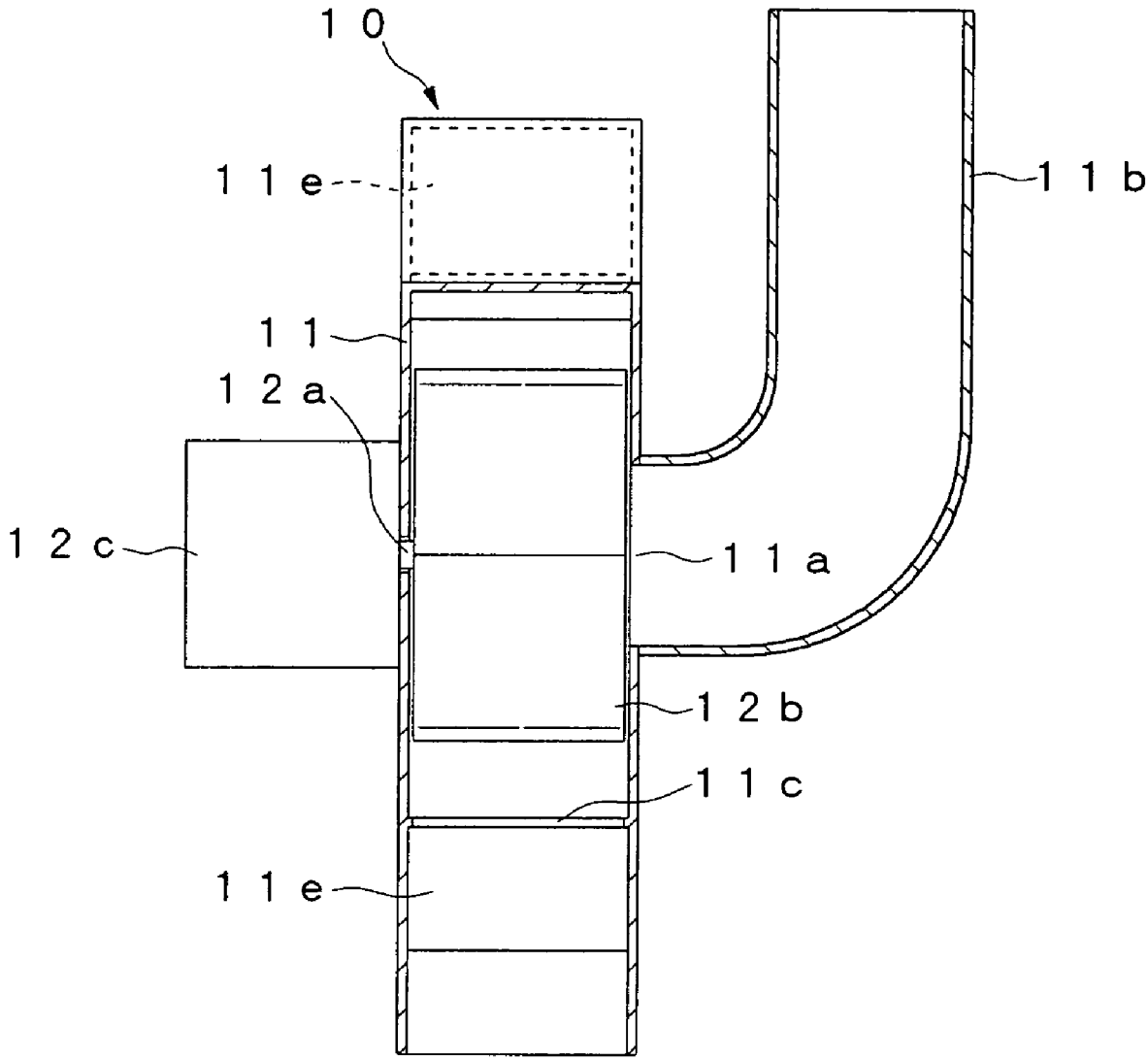
FIG. 3 is a front sectional view of the ice shaver.

The impeller 12 is rotatably provided coaxially with the central axis of the ice shaver body 11, and formed in such a manner that multiple blades 12*b* (four blades in this case) extend radially from the spindle 12*a*. A motor 12*c* for rotatably driving the impeller 12 is connected to the spindle 12*a*, and this motor 12*c* is attached to the side of the other end of the ice shaver body 11 in the axial direction thereof. For the impeller 12, the rotational speed is switched by the motor 12*c* between a high speed as the first rotational speed and a low speed as the second rotational speed in the normal rotation (clockwise rotation in FIG. 2) and the reverse rotation (counterclockwise rotation in FIG. 2). A DC motor for which the control of normal and reverse rotations and of rotational speed is easy is used as the motor 12*c*.

The cutting blade 13 is provided longitudinally of the shaved ice discharging port 11*c* and is fixed to the ice shaver body 11 so that the cutting edge of the cutting blade 13 protrudes into the ice shaver body 11 and faces the tangential direction during the normal rotation of the impeller 12.

Figure 4:
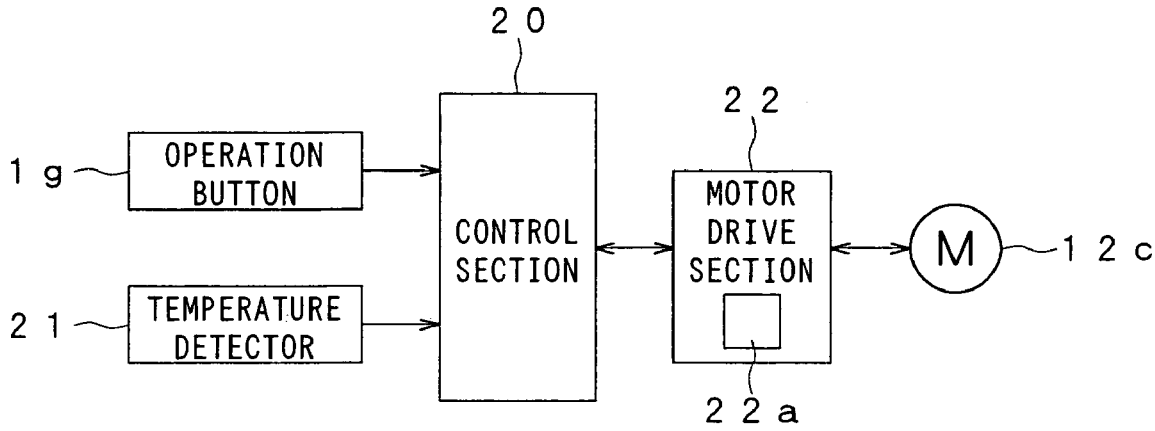
FIG. 4 is a block diagram of a control system.

A control section 20 is constituted by a microcomputer, and in a memory thereof are stored data for determining the time which elapses from a stop of sales of beverages due to the lock of the impeller 12 until a return action is performed on the basis of temperatures in the dispenser casing body 1 and the like in addition to programs related to the sale and production of beverages and a program related to the control of the rotary operation of the impeller 12. Also, as shown in FIG. 4, an operation button 1*g*, a temperature detector 21 which detects a temperature in the vicinity of the ice shaver body 11 and a motor drive section 22*a* are connected to the control section 20.

The motor drive section 22 outputs driving signals for changing the rotational direction and rotational speed of the impeller 12 to the motor 12*c* on the basis of control signals from the control section 20. Also, the motor drive section 22 is provided with a lock detection section 22*a* which cuts off energization to the motor 12*c* on the basis of a change in current value when an overload occurs due to the lock of the impeller 12 or the like and an overcurrent flows through the motor 12*c*, and outputs a signal to the control section 20 by detecting that the energization to the motor 12*c* has been cut off.

Figure 5:
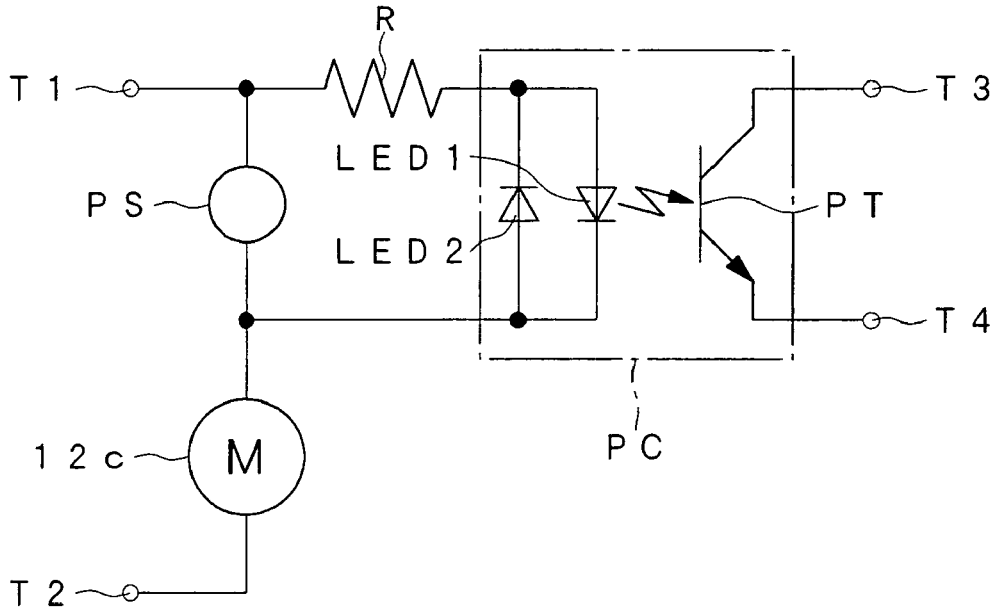
FIG. 5 is a circuit diagram of a lock detection section.

As shown in FIG. 5, the lock detection section 22*a* is constituted by a PolySwitch PS which is provided in series with the motor 12*c* connected to input terminals T1, T2, and a photo coupler PC which is provided in parallel with the PolySwitch PS via a resistor R. The PolySwitch PS is constituted by an element having positive resistance characteristics, such as a PTC thermistor, cuts off energization to the motor 12*c* by increasing resistance when an overcurrent flows through the motor 12*c*, and performs automatic resetting by stopping energization to the motor 12*c*. The photo coupler PC is constituted by light-emitting diodes LED1, LED2 as a pair of light-emitting diodes, which are connected in antiparallel, and a photo transistor PT as a light-receiving element, and each of the light-emitting diodes LED1, LED2 is connected to the PolySwitch PS in parallel. The photo transistor PT is connected to detection terminals T3, T4, and sends a signal to the control section 20 by detecting that one of the pair of light-emitting diodes LED1, LED2 has emitted light.

When in a beverage dispenser constructed as described above, a beverage is selected by the operation button 1*g* and necessary money is put into the beverage dispenser, the beverage is produced in a cup A in accordance with a necessary procedure. For example, in a case where coffee containing sugar and milk is selected as a beverage, powder sugar and milk are charged into the cup A from the raw material storage bins, a coffee liquid extracted by the coffee extractor is poured into the cup A, and a beverage is produced after agitation by the agitator.

Figure 6:
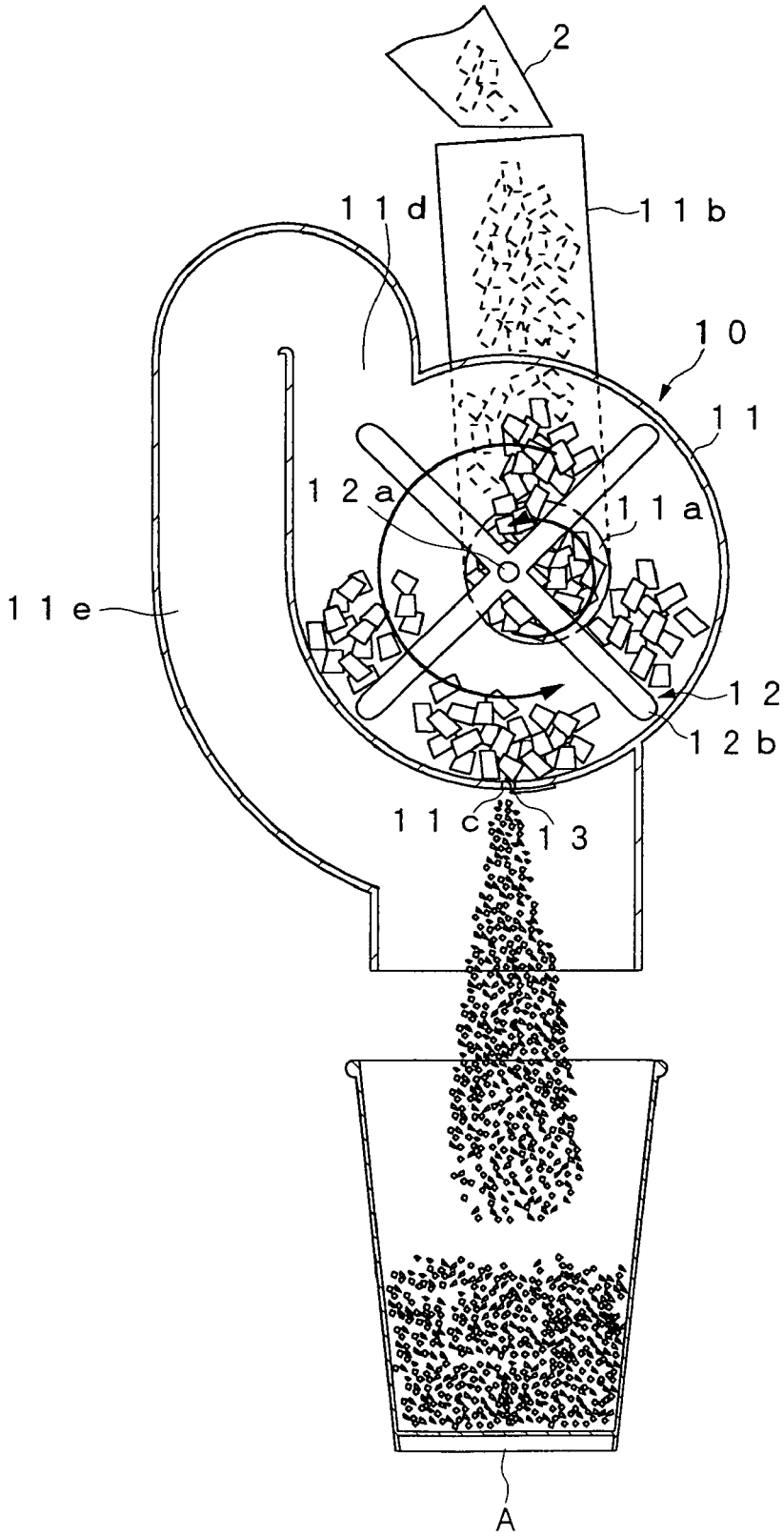
FIG. 6 is a side sectional view of the ice shaver which shows the motion of discharging shaved ice.

Referring now to the flowcharts of FIGS. 8 and 9, the operation of the control section 20 will be described. That is, when a beverage, such as a frappe beverage, into the cup A of which shaved ice is to be charged is selected by the operation button 1*g* (Step S1 in FIG. 8), the impeller 12 is rotated by the motor 12*c* in the reverse direction at a high rotational speed (Step S2 in FIG. 8). And the impeller 12 is stopped after rotation for a specific time (Steps S3 and S10 in FIG. 8). As a result of this, as shown in FIG. 6, granular ice which has been charged through an opening at the top end of the ice introduction pipe 11*b* from the icemaker via a shooter 2 is charged into the ice shaver body 11 from the ice charging port 11*a* while being agitated by coming into contact with the impeller 12 which is rotating at the ice charging port 11*a*, because the opening of the ice charging port 11*a* is arranged in a position which faces the spindle 12*a* of the impeller 12 axially from a side surface of the ice shaver body 11. The granular ice which has been discharged into the ice shaver body 11 rotates in a reverse direction within the ice shaver body 11 along with the impeller 12, whereby the granular ice is shaved by the cutting blade 13 and shaved ice is produced. The shaved ice is charged into the cup A from the shaved ice discharging port 11*c*.

Figure 7:
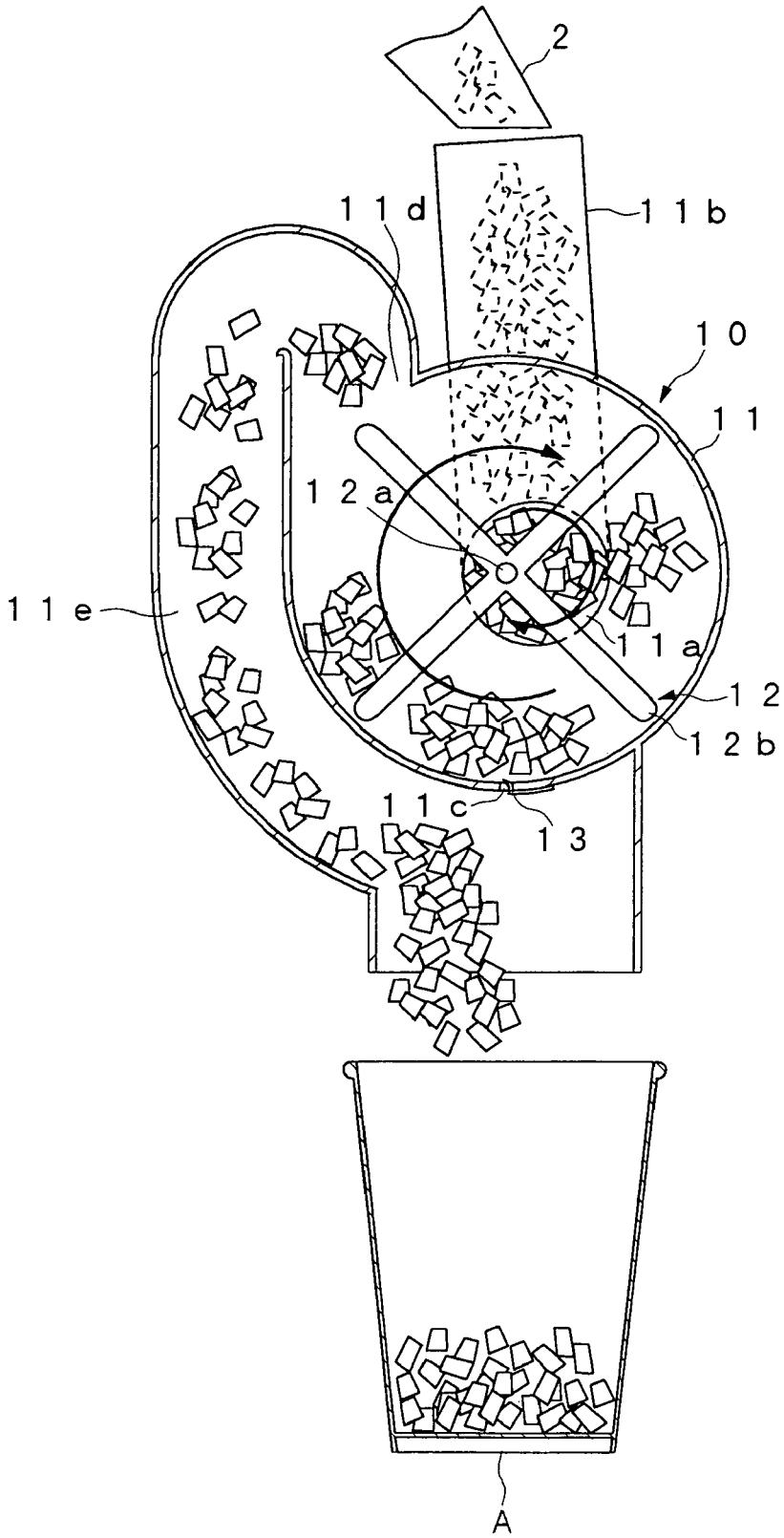
FIG. 7 is a side sectional view of the ice shaver which shows the motion of discharging granular ice.
Figure 8:
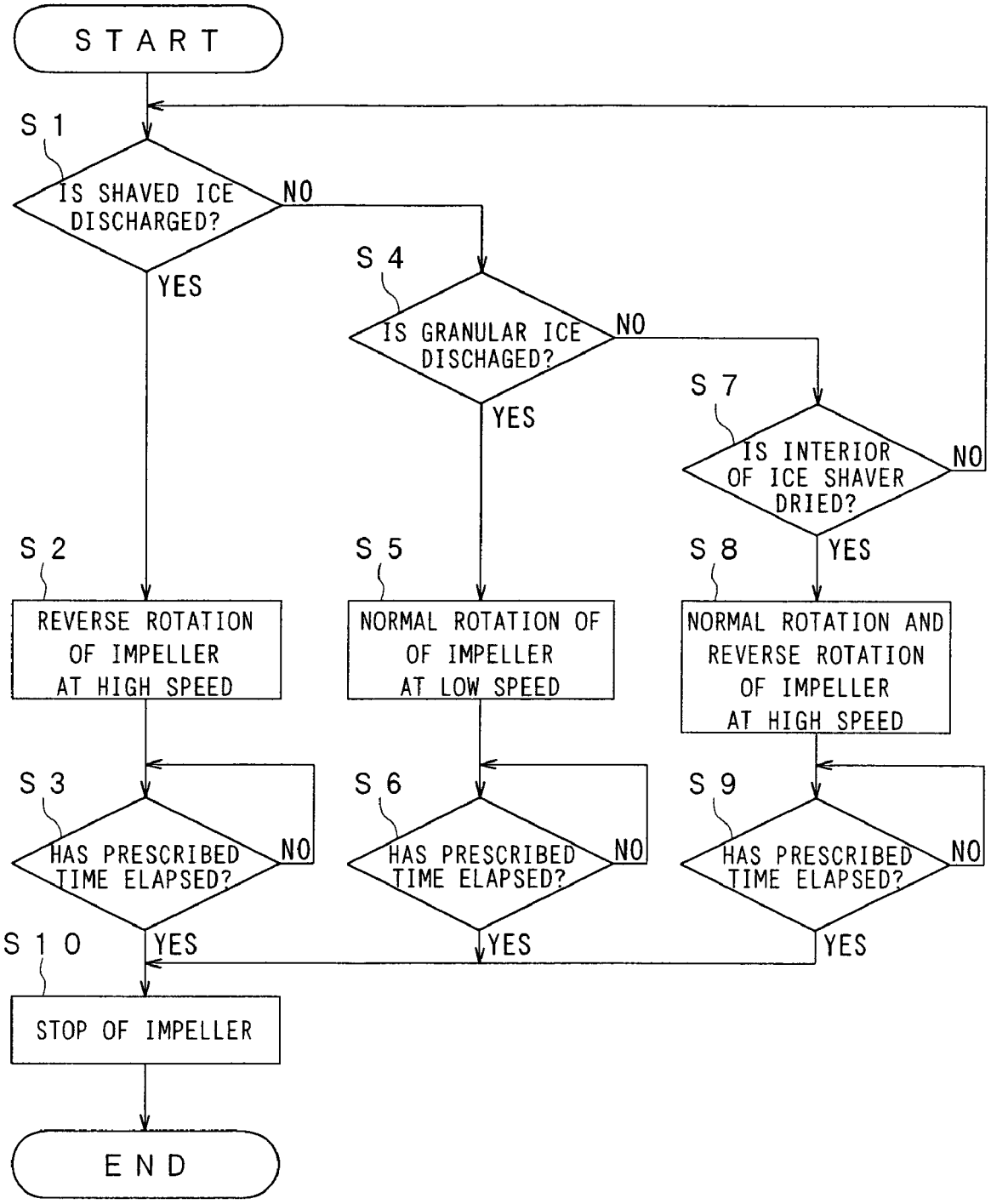
FIG. 8 is a flowchart of the rotation control of an impeller of the ice shaver.

When a beverage, such as an ice beverage, into the cup A of which granular ice is to be charged is selected by the operation button 1*g* (Step S4 in FIG. 8), the impeller 12 is rotated by the motor 12*c* in the normal direction at a low speed (Step S5 in FIG. 8). And the impeller 12 is stopped after rotation for a specific time (Steps S6 and S10 in FIG. 8). As a result of this, as shown in FIG. 7, granular ice which has been charged through an opening at the top end of the ice introduction pipe 11*b* from the icemaker via a shooter 2 is charged into the ice shaver body 11 from the ice charging port 11*a* while being agitated by coming into contact with the impeller 12 which is rotating at the ice charging port 11*a*, because the opening of the ice charging port 11*a* is arranged in a position which faces the spindle 12*a* of the impeller 12 axially from a side surface of the ice shaver body 11. The granular ice which has been discharged into the ice shaver body 11 rotates in the normal direction within the ice shaver body 11 along with the impeller 12, whereby the granular ice is discharged by centrifugal force from the granular ice discharging port 11*d* of the impeller 12. And the granular ice which has been discharged from the granular ice discharging port 11*d* is charged into the cup A via the granular ice guide passage 11*e*. At this time, because the rotational speed of the impeller 12 is a low speed, it is possible to reduce the dropping speed of the granular ice charged into the cup A.

When the drying operation of the interior of the ice shaver body 11 is selected as after the discharge of granular ice or shaved ice or after the cleaning of the interior of the ice shaver body 11 (Step S7 in FIG. 8), the motor 12*c* causes the impeller 12 to rotate in the normal direction and the reverse direction at a high speed (Step S8 in FIG. 8). And the impeller 12 is stopped after rotation for a specific time (Steps S9 and S10 in FIG. 8). As a result of this, the air circulates through the ice shaver body 11 due to the rotation of the impeller 12, and it becomes possible to dry the interior of the ice shaver body 11.

Figure 9:
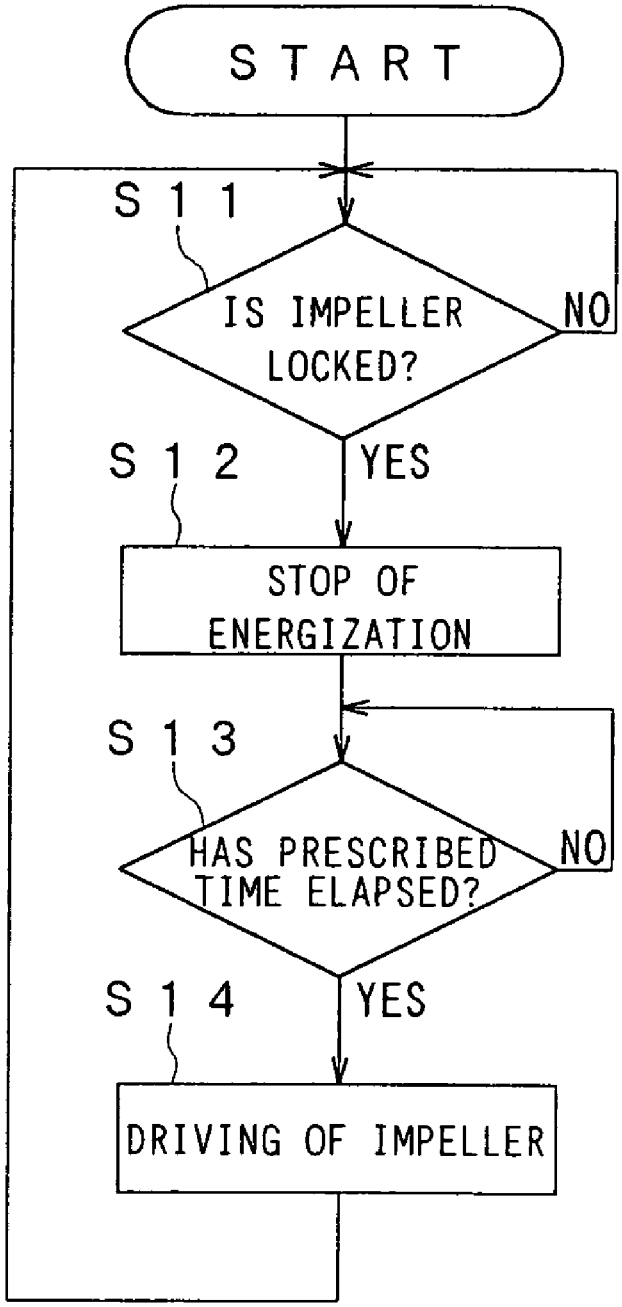
FIG. 9 is a flowchart of lock detection of the impeller.

When the photo coupler PC has detected that during the operation of the ice shaver 10, an overload to the motor 12*c* such as during the lock of the impeller 12 due to the clogging with granular ice occurred (Step S11 in FIG. 9), the energization of the motor 12*c* is stopped and the sale of ice beverages and frappe beverages is stopped (Step S12 in FIG. 9). When a prescribed time until the reset operation determined on the basis of a detected temperature of the temperature detector 21 has elapsed (Step S13 in FIG. 9), a rest operation is performed by driving the impeller 12 (Step S14 in FIG. 9). The relationship between the temperature of the interior of the dispenser casing body 1 and the time until granular ice melts is made available as data by conducting experiments, and the time which elapses from the stop of sale until the reset operation is performed is determined on the basis of the experiment data and a detected temperature of the temperature detector 21.

As described above, according to an ice shaver for a beverage dispenser of this embodiment, the opening of the ice charging port 11*a* is arranged in a position which expose the part of one end surface of the impeller 12 in the direction of the central axis of impeller 12 including the spindle 12*a*, and therefore granular ice can be charged into the ice shaver body 11 from the ice charging port 11*a* while being agitated by the impeller 12 at the ice charging port 11*a*. This provides the advantage that the irregularity that clogging with granular ice occurs on the bottom end side of the ice introduction pipe 11*b* can be prevented.

Also, because the impeller 12 is rotated at a low speed in discharging granular ice from the ice shaver 10, it is possible to reduce the discharge speed of the granular ice which is discharged from the ice shaver body 11 and hence it is possible to prevent the scattering of a beverage in discharging granular ice into the cup A.

When an overload occurs in the motor 12*c* due to the locking of the impeller 12 caused by the clogging with granular ice etc., the driving of the impeller 12 is stopped. Therefore, the motor 12*c* and the motor drive section 22*a* can be protected from damage due to overcurrent and heating and troubles in the equipment can be prevented.

Because the energization to the motor 12*c* is cut off by the PolySwitch PS if an overload occurs in the motor 12*c* due to the lock of the impeller 12 or the like, the construction becomes simpler than when the rotation of the impeller 12 is detected by use of a photo sensor etc. and the cost of manufacturing can be reduced.

Because it is ensured that the photo coupler PC detects that an overload occurred in the motor 12*c* due to the lock of the impeller 12 etc., it is possible to send a detection signal of the locking of the impeller 12 to the control section 20 and it becomes possible to take appropriate measures such as the stop of sale and the performing of a reset action.

Furthermore, when an overcurrent to the motor 12*c* is detected as during the lock of the impeller 12 etc., the energization to the motor 12*c* is stopped and the cancellation of the lock is ascertained by energizing the motor 12*c* after a lapse of a prescribed time. Therefore, the sale of beverages can be started again by ascertaining that the lock of the impeller 12 has been cancelled and this provides the advantage that sales opportunities are not lost.

Figure 10:
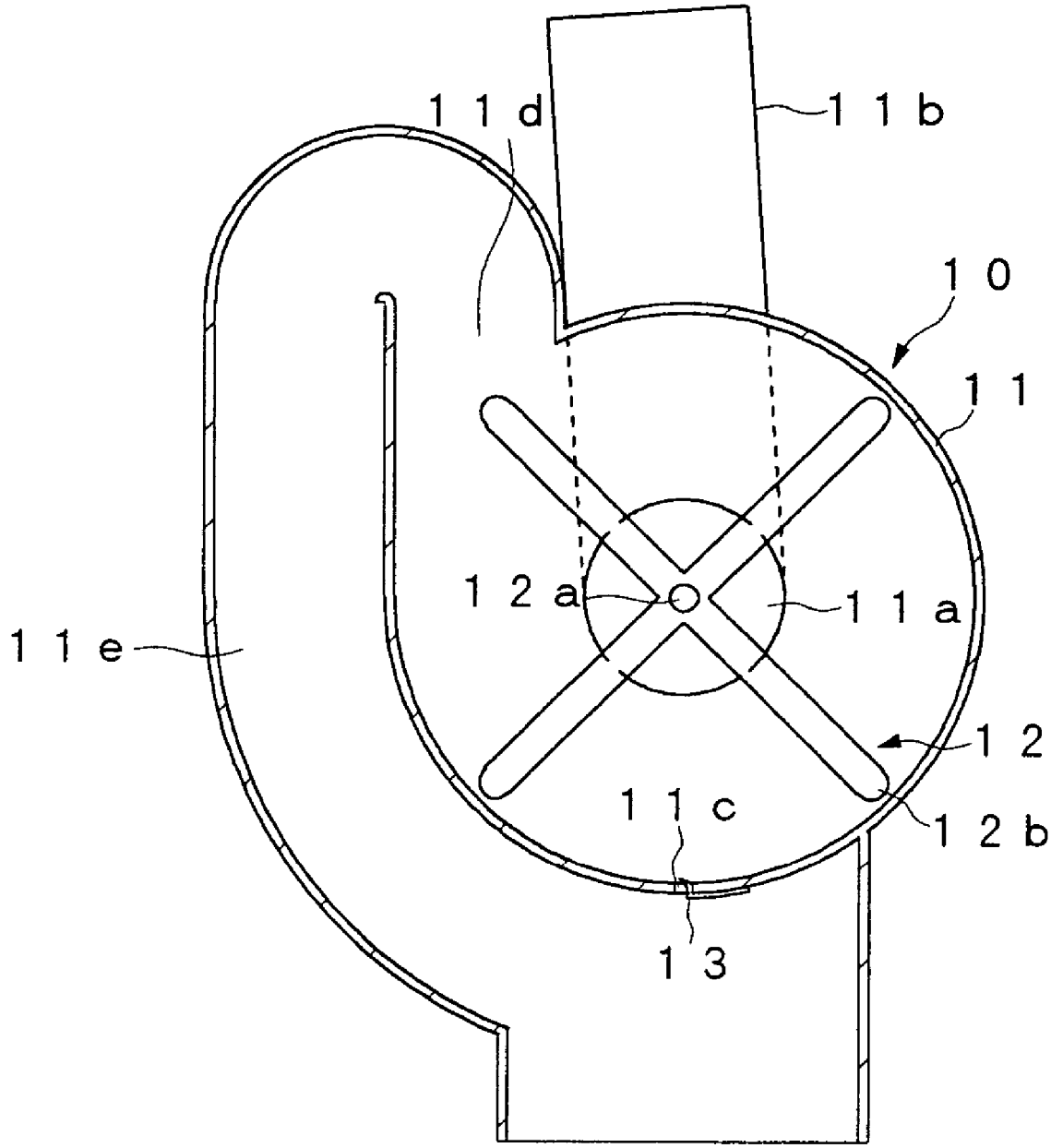
FIG. 10 is a side sectional view of an ice shaver in another embodiment.

Incidentally, although in the above-described embodiment is shown an example in which the opening of the ice charging port 11*a* is decentered from the spindle 12*a* of the impeller 12 and arranged in a position which faces the spindle 12*a* axially from a side surface of the ice shaver body 11, it is possible to obtain the same effect as in the above-described embodiment even by providing the opening of the ice charging port 11*a* coaxially with the spindle 12*a* as shown in FIG. 10.

The preferred aspects described in this specification are illustrative ones and are not limited ones. The scope of the present invention is shown by the claims and all examples of modifications that fall under the meanings of these claims are included in the present invention.

What is claimed is:

1. An ice shaver for a beverage dispenser, comprising:

an icemaker body having an ice charging port, a granular ice discharging port and a shaved ice discharging port;

a cutting blade provided in the vicinity of the shaved ice discharging port of the ice shaver body; and an impeller which is rotatably provided within the ice shaver body, is provided in such a manner that a part of one end surface thereof in a direction of a central axis including a center of rotation is exposed from the ice charging port, discharges granular ice charged from the ice charging port into the ice shaver body from the granular ice discharging port by being rotated in one direction, shaves the granular ice charged from the ice charging port into the ice shaver body, and discharges the shaved ice from the shaved ice discharging port by being rotated in the other direction.

2. An ice shaver for a beverage dispenser, comprising:

an icemaker body having an ice charging port, a granular ice discharging port and a shaved ice discharging port;

a cutting blade provided in the vicinity of the shaved ice discharging port of the ice shaver body;

an impeller which is rotatably provided within the ice shaver body, discharges granular ice charged from the ice charging port into the ice shaver body from the granular ice discharging port by being rotated in one direction, shaves the granular ice charged from the ice charging port into the ice shaver body, and discharges the shaved ice from the shaved ice discharging port by being rotated in the other direction;

a motor which rotates the impeller in one direction and in the other direction; and a rotational speed changeover unit which sets the rotational speed of the motor at a prescribed first rotational speed when the impeller is rotated in the other direction and at a prescribed second rotational speed which is lower than the first rotational speed when the impeller is rotated in one direction.

3. An ice shaver for a beverage dispenser, comprising:

an icemaker body having an ice charging port, a granular ice discharging port and a shaved ice discharging port;

a cutting blade provided in the vicinity of the shaved ice discharging port of the ice shaver body;

an impeller which is rotatably provided within the ice shaver body, discharges granular ice charged from the ice charging port into the ice shaver body from the granular ice discharging port by being rotated in one direction, shaves the granular ice charged from the ice charging port into the ice shaver body, and discharges shaved ice from the shaved ice discharging port by being rotated in the other direction;

a motor which rotates the impeller in one direction and in the other direction; and a driving stop unit which stops the driving of the motor when rotation resistance higher than a prescribed level acts on the impeller which is rotating.

4. The ice shaver according to claim 3, wherein:

the driving stop unit cuts off energization to the motor when a current flowing through the motor changes above a prescribed current value.

5. The ice shaver according to claim 4, further comprising:

a lock detection unit which detects that the impeller has been locked by detecting that the energization to the motor has been cut off by the driving stop unit.

6. The ice shaver according to claim 5, further comprising:

an energization control unit which stops the energization to the motor when the lock detection unit detects that the impeller has been locked, and energizes the motor after a lapse of a certain time since the stop of the energization to the motor.

7. The ice shaver according to claim 6, further comprising:

a temperature detector which detects a temperature in the vicinity of the ice shaver body; and a setting unit which sets, on the basis of a detected temperature detected by the temperature detector, a time which elapses from the stop of the energization to the motor until the motor is energized.

8. The ice shaver according to claim 6, further comprising:

a temperature detector which detects a temperature in the vicinity of the ice shaver body;

a storage unit which stores data on a time until granular ice melts which corresponds to the temperature in the vicinity of the ice shaver body; and a setting unit which sets, on the basis of a detected temperature detected by the temperature detector and the data stored in the storage unit, a time which elapses from the stop of the energization to the motor until the motor is energized.

* * * * *